US005647560A

United States Patent [19]

Schnatz et al.

[11] Patent Number: 5,647,560

[45] Date of Patent: Jul. 15, 1997

[54] STEERING LOOP FOR MISSILES

[75] Inventors: Jürgen Schnatz, Deggenhausertal; Willi Ruggaber, Owingen, both of Germany

[73] Assignee: Bodenseewerk Gerätetechnik GmbH, Überlingen/Bodensee, Germany

[21] Appl. No.: 557,665

[22] Filed: Nov. 13, 1995

[30] Foreign Application Priority Data

Nov. 26, 1994 [DE] Germany ..... 44 42 134.6

[51] Int. Cl.[6] ..... F42B 15/01; F41G 7/00

[52] U.S. Cl. ..... 244/3.15; 244/3.16

[58] Field of Search ..... 244/3.15, 3.16, 244/3.21

[56] References Cited

U.S. PATENT DOCUMENTS

| | | | |
|---|---|---|---|
| 4,189,116 | 2/1980 | Ehrich et al. | 244/3.16 |
| 4,508,293 | 4/1985 | Jones | 244/3.15 |
| 4,717,822 | 1/1988 | Byren | 244/3.16 |
| 5,052,637 | 10/1991 | Lipps | 244/3.15 |
| 5,062,583 | 11/1991 | Lipps et al. | 244/3.15 |
| 5,253,823 | 10/1993 | Lawrence | 244/3.15 |
| 5,464,174 | 11/1995 | Laures | 244/3.15 |

FOREIGN PATENT DOCUMENTS

| | | |
|---|---|---|
| 0509394A1 | 10/1992 | European Pat. Off. . |
| 0655599A1 | 5/1995 | European Pat. Off. . |
| 0482353 | 9/1991 | Germany . |

*Primary Examiner*—Michael J. Carone
*Assistant Examiner*—Theresa M. Wesson
*Attorney, Agent, or Firm*—Lowe, Price, LeBlanc & Becker

[57] ABSTRACT

In a steering loop for missiles which are guided to a target by means of a seeker head, the seeker head having a limited field of view, the seeker head determines the line of sight to the target by look angles with respect to missile-fixed pitch and yaw axes. A signal processing computer receives the seeker head signals and generates signals which determine the motion of the missile. These signals are applied to a steering system and guide the missile to the target. In order to avoid loss of the target due to limitations of the field of view of the seeker head, the signal processing computer influences the signals determining the motion of the missile such as to ensure a motion of the missile which holds the line of sight always within the field of view.

13 Claims, 7 Drawing Sheets

STEERING LOOP FOR MISSILES

BACKGROUND OF THE INVENTION

The invention relates to a steering loop for missiles which are guided to a target by means of a seeker head. The steering loop has a seeker head, which determines the line of sight to a target by look angles with reference to missile-fixed pitch and yaw axes. The seeker head provides seeker signals. The seeker signals are applied to signal processing means. The signal processing means generate signals determining the motion of the missile. The steering loop, furthermore, contains steering means for guiding the missile to the target. The signals from the signal processing means are applied to these steering means.

Conventionally, the seeker head has an imaging optical system and a sensor. The imaging optical system has an optical axis. A control loop including the sensor causes the optical axis of the optical system to point towards a target detected by the sensor. Then this optical axis defines a "line of sight" to the target. The orientation of the line of sight relative to the missile can be defined by two "look angles" about a yaw axis and a pitch axis, respectively. The optical system with the sensor represents a "seeker".

The seeker head provides seeker head signals. Steering signals are generated in accordance with a steering law, the steering signals guiding the missile to the detected target. According to the steering law of "proportional navigation", for example, the steering signals are proportional to the angular rate of the line of sight in inertial space. The steering signals control the movements of the control surfaces. With proportional navigation, the steering system seeks to maintain the line-of-sight stationary in space. The control loop with the seeker as measuring element and the control surfaces (or the like) as actuator is called "steering loop", by which the missile is guided to the target.

A lateral acceleration of the missile is to be achieved by the movement of the control surfaces. To this end, the missile changes its angle of attack, i.e. the angle between the flight velocity vector and the longitudinal axis of the missile. By this change of the angle of attack, the look angles of the seeker head are changed. The missile changes its attitude in space relative to the substantially space-fixed line of sight.

The optical path of rays of the seeker passes through a window near the tip of the missile. This window determines the field of view of the seeker. For optical and aerodynamic reasons, this window is often provided sidewards at the tip of the missile. Thereby, the amount of the admissible look angles is limited. If the line of sight to the target leaves the field of view of the missile, the seeker head loses the target.

Examples of missiles having windows sidewise at the tip of the missile are shown in U.S. Pat. No. 4,717,822 and European patent application 0,482,353.

SUMMARY OF THE INVENTION

It is an object of the invention to design a steering loop of the type mentioned in the beginning such that the risk of target loss due to the limitation of the field of view is, at least, substantially reduced.

According to the broad aspect of the invention, this object is achieved by the signal processing means having means for influencing signals determining the motion of the missile such that they ensure a motion of the missile by which the line of sight is always retained within the field of view of the seeker head.

Thus the signals determining the motion of the missile, such as the steering signals, are determined not only by the steering law so as to guide the missile optimally to the target, but, in addition, are also influenced to keep the line of sight safely within the field of view of the seeker head. Thus a steering signal which might be optimal for the target tracking may be limited and made less optimal, if the lateral acceleration corresponding to the optimal steering signal the line of sight would travel out of the field of view and the target would be lost. The optimal target tracking makes no sense, if the target gets eventually lost and the missile, thereby, loses its bearing. The task of keeping the line of sight within the field of view of the seeker head may even require a roll movement of the missile not demanded by the steering law, if the window would be arranged symmetrically with respect to the missile.

An embodiment of the invention is described hereinbelow with reference to the accompanying drawings.

DESCRIPTION OF PREFERRED EMBODIMENT OF THE INVENTION

Figure 1:
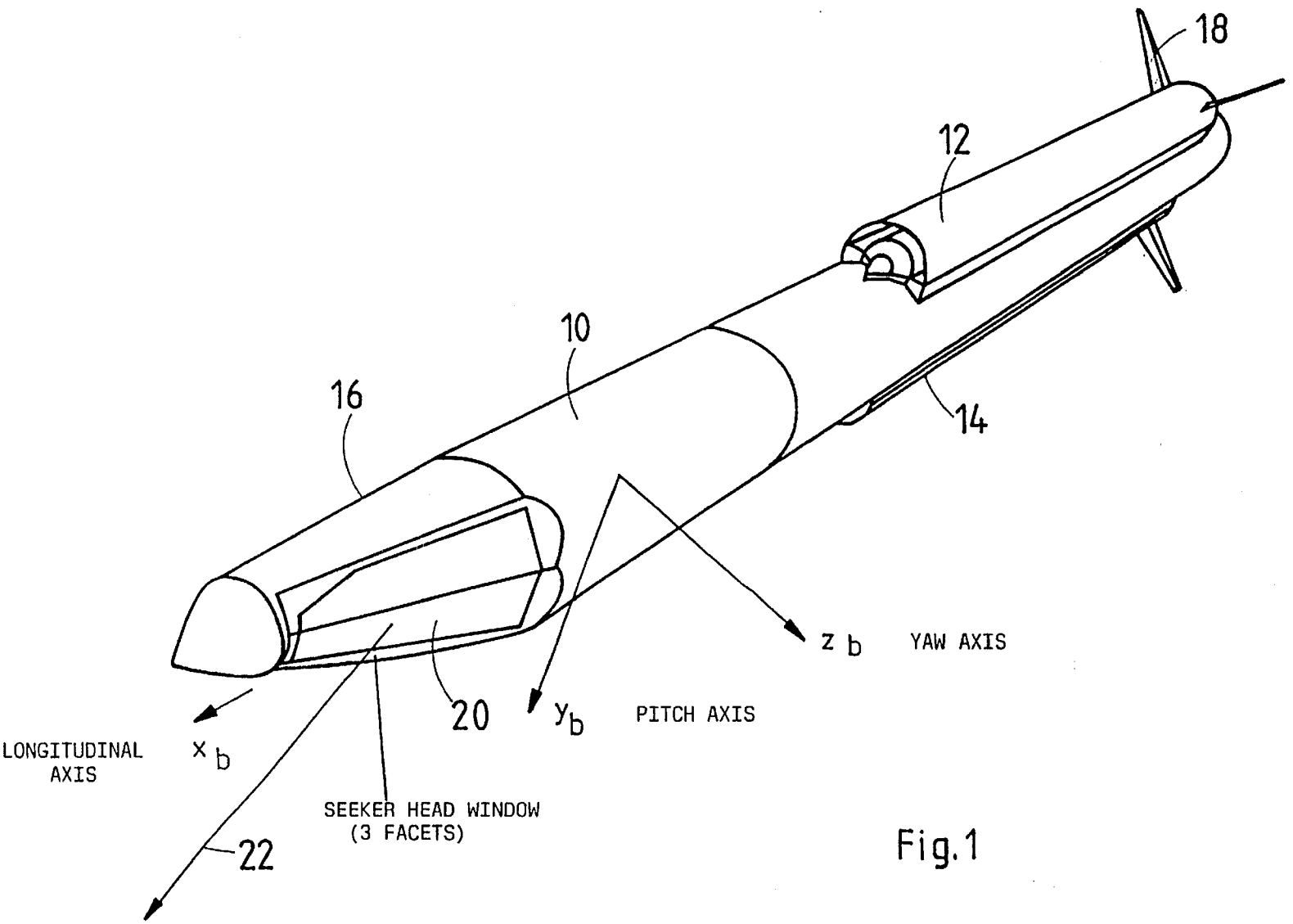
FIG. 1 is a schematic-perspective illustration of a target-tracking missile with a seeker head, the path of rays of which passes through a window, which is arranged sidewise in the region of the tip of the missile.

FIG. 1 is a schematic-perspective illustration of a missile 10 having engines 12 and 14, a seeker head 16 at the tip, and control surfaces 18. The seeker head 16 has a window 20 with three facets. The seeker (not visible) looks with a line of sight 22 through this window 20. Reference numeral $x_b$ designates the direction of the longitudinal axis of the missile 10. The orientation of the line of sight 22 relative to the missile 10 is defined by two angles $\lambda_{yp}$ and $\lambda_{zp}$ about the missile-fixed pitch and yaw axes $y_b$ and $z_b$, respectively.

Figure 2:
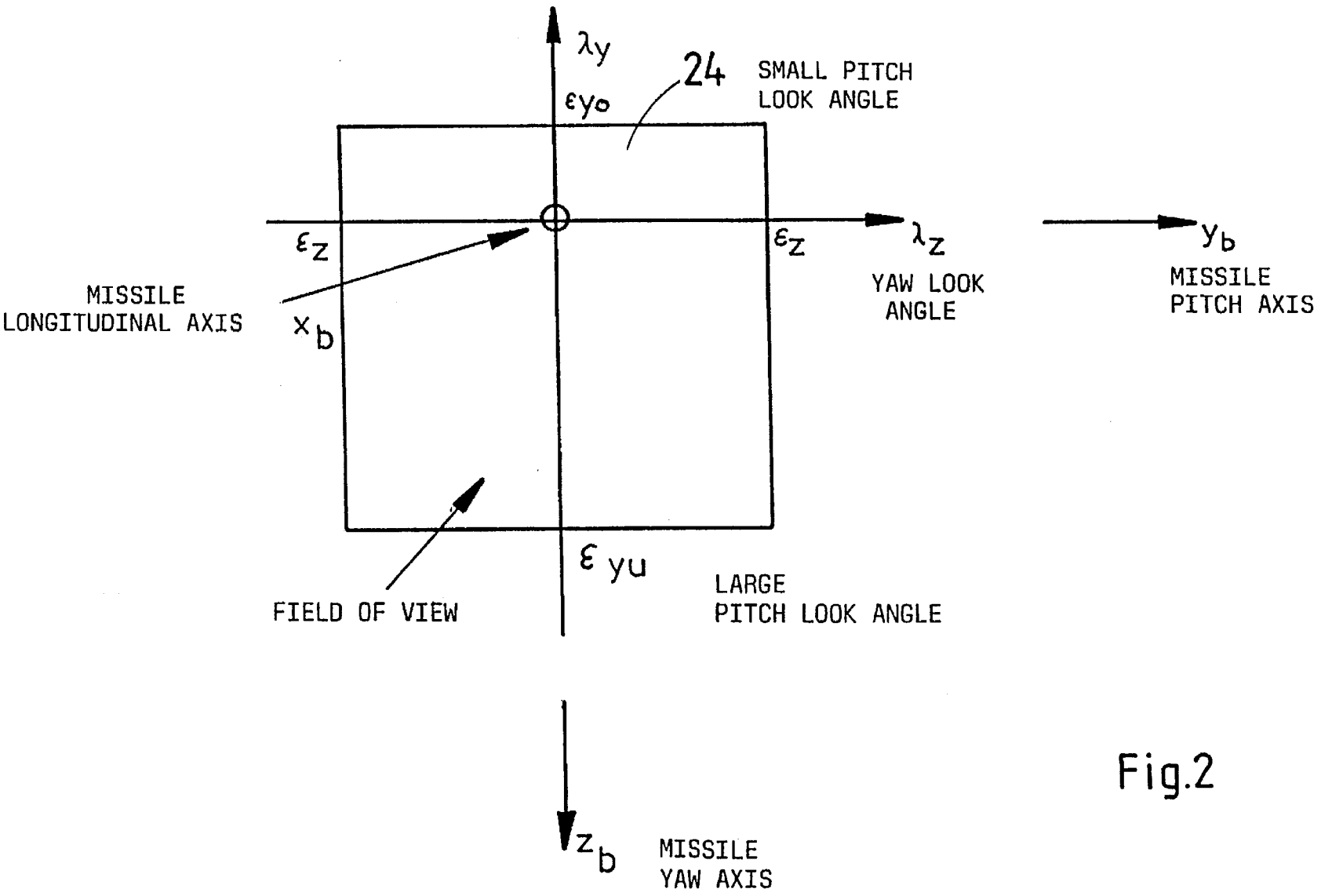
FIG. 2 illustrates the field of view of the seeker of the seeker head of FIG. 1 with respect to the direction of the longitudinal axis of the missile.

FIG. 2 shows the position of the field of view 24 of the seeker head 16 with respect to the direction of the longitudinal axis $x_b$. The field of view is limited about the pitch axis $y_b$ by the maximum look angles $\epsilon_{yo}$ and $-\epsilon_{yu}$. About the yaw axis, the field of view is limited by the maximum yaw look angles $-\epsilon_z$ and $+\epsilon_z$. The field of view 24 is heavily unsymmetrical about the pitch axis. The field of view 24 is symmetrical about the yaw axis, but is, of course, limited.

Figure 3:
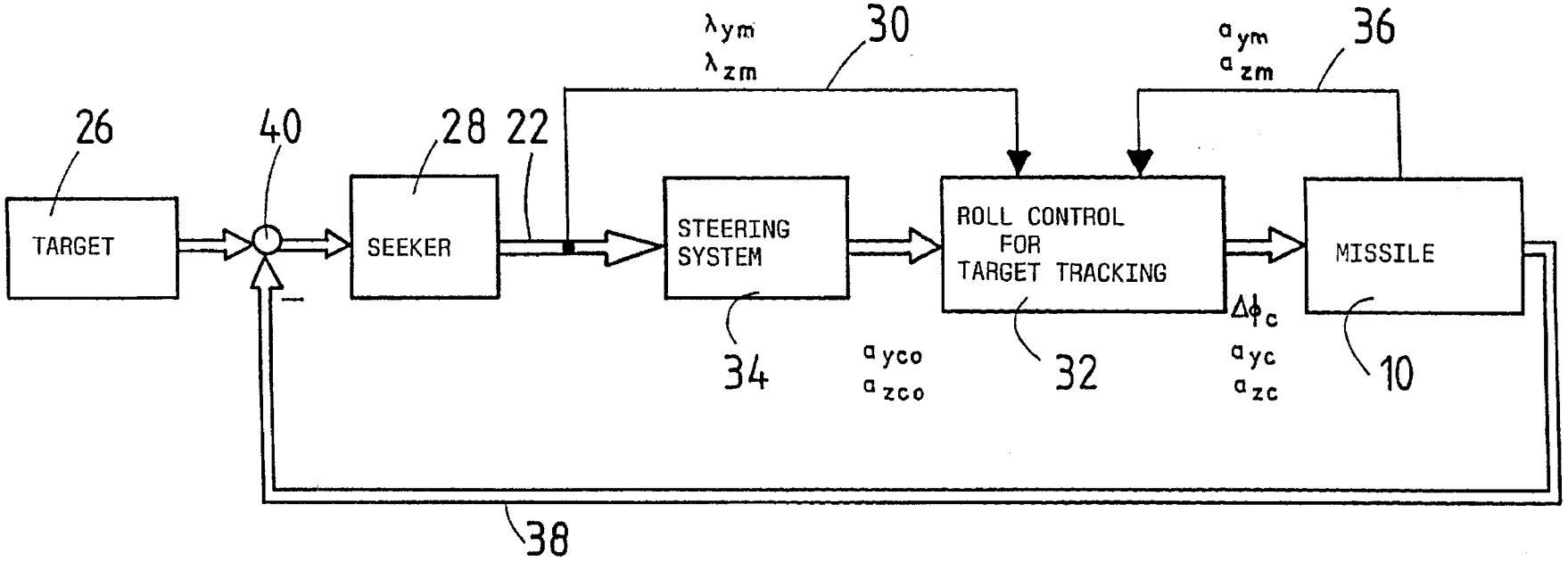
FIG. 3 is a block diagram and shows the steering loop of the missile of FIG. 1.

FIG. 3 illustrates the steering loop. Numeral 26 designates a target. The target 26 is detected by the seeker 28. The seeker 28 is caused to point, with its line of sight, to the target. The attitude of the line of sight 22 can be picked off from the seeker 28, for example in the form of cardan angles. The look angles $\lambda_{ym}$ and $\lambda_{zm}$ thus measured are applied, as indicated by a loop 30, to a circuit 32 counter-acting target loss.

Apart from this, steering is effected by a steering computer 34 in accordance with the steering law depending on the line of sight or the angular rate thereof. The steering computer commands steering-law lateral accelerations $a_{yco}$ and $a_{zco}$, by which the missile 10 should be caused to follow the target 26 in accordance with the steering law applied. These steering-law lateral accelerations $a_{yco}$ and $a_{zco}$ are, however, also applied to the circuit 32 and, if required, modified to counter-act target loss or to initiate a roll movement of the missile. The circuit receives also the measured lateral accelerations $a_{ym}$ and $a_{zm}$ of the missile 10. This is indicated by a loop 36. The circuit 32 provides commanded lateral accelerations $a_{yc}$ and $a_{zc}$ in the directions of the pitch or yaw axes, respectively. Furthermore, the circuit, if required, provides a command $\Delta\Phi_c$, which initiates a roll movement of the missile 10. The motion of the missile, in turn, affects the seeker 28. This is indicated by a loop 38 and a summing point 40.

Figure 4:
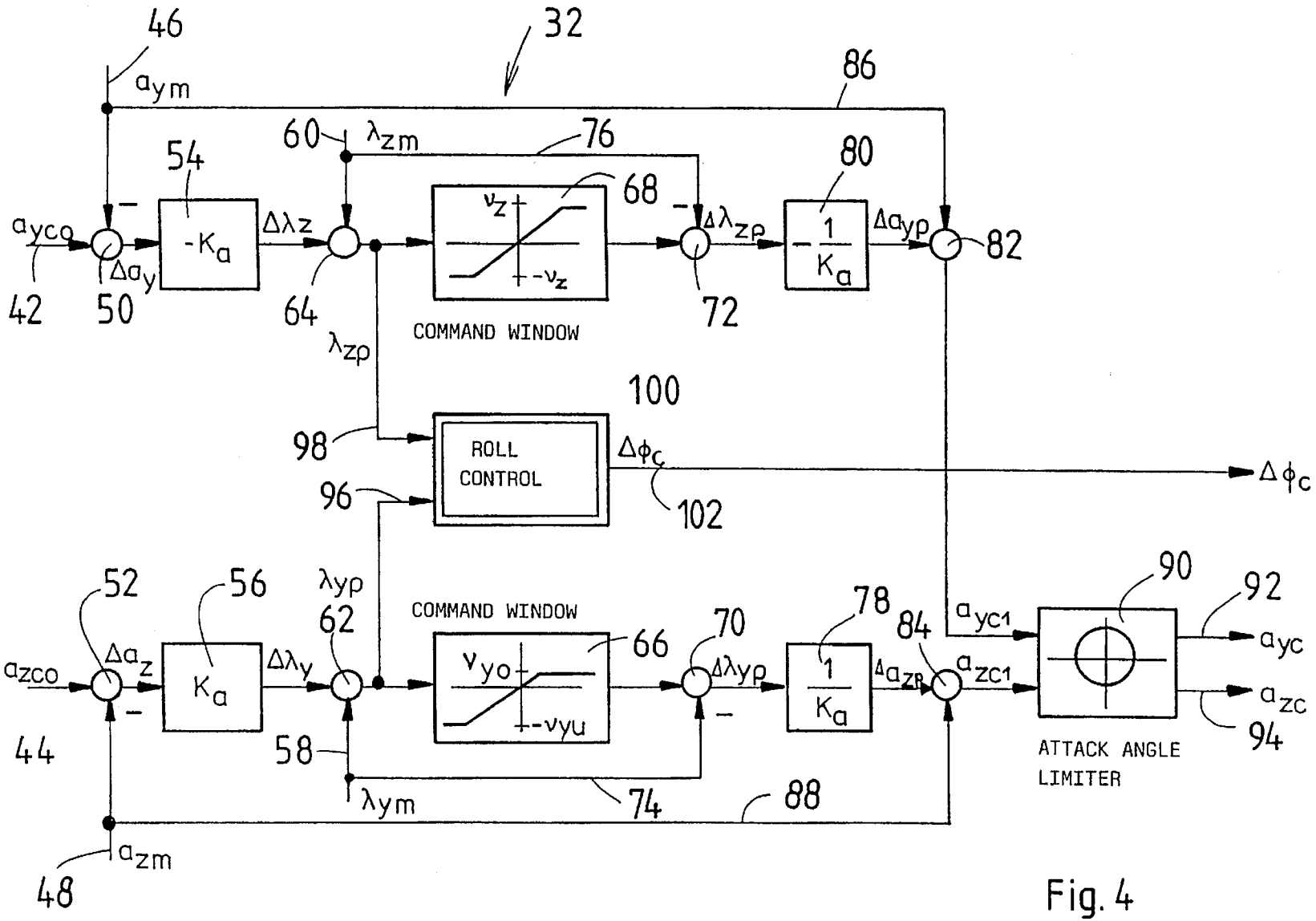
FIG. 4 is a block diagram and shows the means for influencing the signals determining the motion of the missile, whereby the line of sight is always maintained within the field of view of the seeker head.

The circuit 32 is illustrated in detail in FIG. 4.

The steering-law transverse acceleration $a_{yco}$ in the direction of the pitch axis, provided by the steering computer 34, is applied to an input 42. The measured lateral acceleration $a_{ym}$ of the missile in the direction of the yaw axis, is applied to an input 46. The measured lateral acceleration $a_{zm}$ of the missile 10 in the direction of the yaw axis is applied to an input 48. The differences of the steering-law lateral accelerations and of the measured lateral accelerations are formed at summing points 50 and 52:

$$\Delta a_y = a_{yco} - a_{ym}$$

$$\Delta a_z = a_{zco} - a_{zm}.$$

These are the changes of the lateral accelerations, which would be obtained, if the steering-law lateral accelerations computed by the steering computer 34 were generated. These changes would result in changes of the angle of attack. Such changes result in changes of opposite sign of the look angles. The missile 10 is rotated about pitch and yaw axes relative to the substantially stationary line of sight. If, for example, the pitch angle of the missile 10 is changed clockwise relative to inertial space and the line of sight 22 stationary therein, in order to generate a lateral acceleration acting in the direction of the yaw axis, then the look angle, i.e. the angle at which the target is seen from the missile 10, is changed counter-clockwise. Therefore, a change of the look angle can be predicted from a commanded change of the lateral acceleration. FIG. 4 assumes that the relation between commanded change of the lateral acceleration and the predicted change of the associated look angle is proportionality:

$$\Delta\lambda_z = -K_a \Delta a_y$$

$$\Delta\lambda_y = K_a \Delta a_z.$$

Multiplication with the coefficients $-K_a$ and $K_a$, respectively is illustrated in FIG. 4 by blocks 54 and 56, respectively. Instead of the linear relation, also more complex and non-linear relations between the changes of the look angles and the commanded changes of the lateral accelerations may be used.

From these changes of the look angles, predicted look angles can be formed as sum of the instantaneous, measured look angles and the changes of the look angles. The measured look angles $\lambda_{ym}$ and $\lambda_{zm}$ are picked off from the seeker 28 (FIG. 3) and are applied to the circuit 32 through loop 30. These measured look angles $\lambda_{ym}$ and $\lambda_{zm}$ are applied to inputs 58 and 60, respectively, of the circuit 32 (FIG. 4). The computed changes of the look angles are added to the measured look angles $\lambda_{ym}$ and $\lambda_{zm}$ at summing points 62 and 64, respectively. This yields the predicted look angles $\lambda_{yp}$ and $\lambda_{zp}$, respectively.

The predicted look angles $\lambda_{yp}$ and $\lambda_{zp}$ are applied to limiters 66 and 68, respectively. The limiters limit the values of the look angles to predetermined limit values $\nu_{yo}$ and $-\nu_{yu}$, or $\nu_z$ and $-\nu_z$, respectively. The values of $\nu_{yo}$ and $-\nu_{yu}$, or $\nu_z$ and $-\nu_z$ are slightly smaller than the values $\epsilon_{yo}$ and $\epsilon_{yu}$ or $-\epsilon_z$ und $+\epsilon_z$, respectively, mentioned above with reference to FIG. 2. For safety, the range fixed by the limiters 66 and 68 is slightly reduced relative to the real field of view defined by the window 20.

Accordingly, the limiters 66 and 68 provide limited values of the predicted look angles $\lambda_{yp}$ and $\lambda_{zp}$, respectively, if the predicted look angles exceed the field of view fixed by the limiters 66 and 68. At summing points 70 and 72, the measured look angles are subtracted from these limited look angles. This is represented by loops 74 and 76, respectively. This yields limited changes of the look angles $\Delta\lambda_{yp}$, $\Delta\lambda_{zp}$. These limited changes of the look angles are now subjected to an operation which is inverse to the operation represented by the blocks 56 and 54, respectively. In the present case these inverse operations are multiplications by $1/K_a$ and $-1/K_a$, respectively. In FIG. 4, these inverse operations are represented by blocks 78 and 80, respectively. The inverse operation represented by block 80 provides a modified change $\Delta a_{yp}$ of the lateral acceleration in the direction of the pitch axis. The inverse operation represented by block 78 provides a modified change $\Delta a_{zp}$ of the lateral acceleration in the direction of the yaw axis. These modified changes are added to the corresponding measured lateral accelerations $a_{ym}$ and $a_{zm}$, respectively, at summing points 82 and 84, respectively. This is illustrated in FIG. 4 by loops 86 and 88, respectively.

Thereby, first commanded accelerations $a_{yc1}$ and $a_{zc1}$ are obtained. These first commanded accelerations $a_{yc1}$ and $a_{zc1}$ are applied to further limiter means 90. There they are subjected to further limitation, if necessary, in the case that the angle of attack commanded with a lateral acceleration becomes too large for aerodynamic reasons. Then commanded accelerations $a_{yc}$ and $a_{zc}$ appear at outputs 92 and 94, respectively. These commanded accelerations $a_{yc}$ and $a_{zc}$ control the control surfaces of the missile, as can be seen from FIG. 3.

In addition, a roll movement can be commanded to the missile 10, whereby the missile 10 is moved into a roll position in which the window 20 (FIG. 1) is located favorably to the line of sight 22. The yaw look angle $\lambda_z$ is to be small and the pitch look angle $\lambda_y$ is to lie in the less heavily limited, negative range (at the bottom in FIG. 2). To this end, the predicted look angles $\lambda_{yp}$ and $\lambda_{zp}$ are applied to inputs 96 and 98, respectively, of a roll control 100. The roll control 100 provides a roll command $\Delta\Phi_c$ at an output 102.

The roll command $\Delta\Phi_c$ results from the predicted look angles $\lambda_{yp}$ and $\lambda_{zp}$ in accordance with predetermined rules:

(a) If the predicated yaw look angle $\lambda_{zp}$ and the predicted pitch look angle $\lambda_{yp}$ meet the condition:

$$-\delta \leq \lambda_{zp} \leq \delta$$

and $$\lambda_{yp} \leqq \nu_{yo},$$

$\delta$ und $\nu_{yo}$ being the limits of a "window" for the line of sight in the field of view 24 of the seeker head 16, the roll position of the missile 10 will be retained.

(b) If the predicted look angles lie within ranges $$-\delta \leqq \lambda_{zp} \leqq \delta$$

and $$\lambda_{yp} \geqq \nu_{yo},$$

a 180° roll rotation of the missile is commanded.

(c) If the predicted look angles $\lambda_{zp}$ and $\lambda_{yp}$ lie in the ranges $$\lambda_{zp} \leqq -\delta;\ \lambda_{yp} \leqq -\nu_{yo} \text{ or } \lambda_{zp} \geqq \delta;\ \lambda_{yp} \leqq -\nu_{yo}$$

a roll rotation of the missile 10 through the angle $$\Delta\Phi_c = \arctan(\lambda_{zp}/\lambda_{yp})$$

is commanded.

(d) If the predicted look angles $\lambda_{zp}$ and $\lambda_{yp}$ lie within the ranges $$\lambda_{zp} \leqq -\delta;\ -\nu_{yo} \geqq \lambda_{yp} \leqq \nu_{yo} \text{ or } \lambda_{zp} \geqq \delta;\ -\nu_{yo} \leqq \lambda_{yp} \leqq \nu_{yo}$$

a roll rotation of the missile 10 through an angle of −90° is commanded in the case of a positive predicted yaw look angle $\lambda_{zp}$, and a roll rotation through an angle of +90° is commanded in the case of a negative predicted yaw look angle $\lambda_{zp}$.

Figure 5:
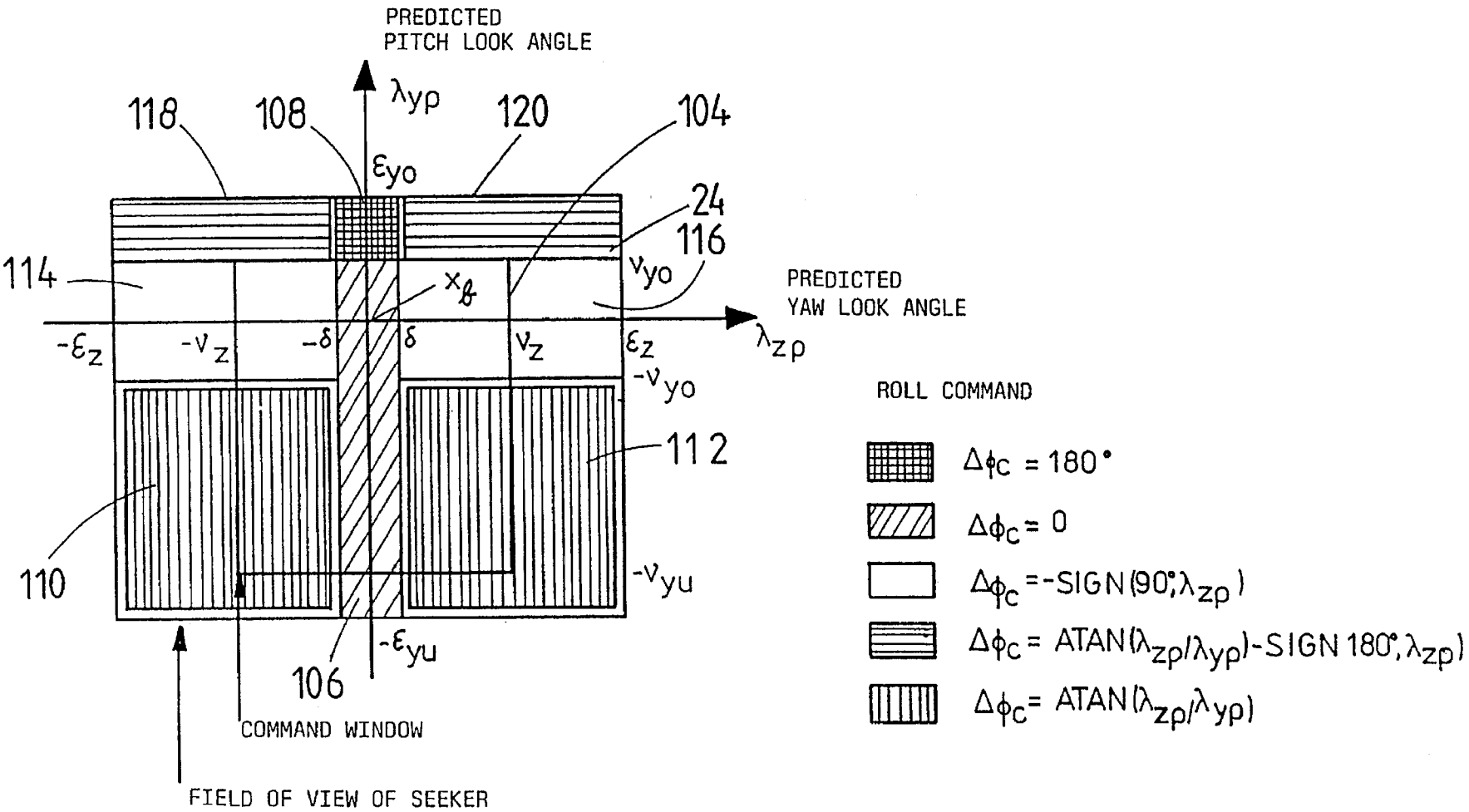
FIG. 5 shows the "command window", which symbolizes the rules in accordance with which a roll movement is initiated depending on the look angles.

This is illustrated in FIG. 5 in the form of a "command window". In horizontal direction in FIG. 5, the predicted yaw look angles $\lambda_{zp}$ are plotted. In vertical direction in FIG. 5, the predicted pitch look angles $\lambda_{yp}$ are plotted. Therefore, each point in the area of FIG. 5 represents a line of sight defined by two look angles.

FIG. 5 also shows the real field of view 24 defined by the window 20. Furthermore, the limited field of view 104 is illustrated, which lies within the real field of view 24 and is fixed by the limiter values $\nu_{yo}$ and $-\nu_{yu}$ or $\nu_z$ and $-\nu_z$ of the limiters 66 and 68, respectively.

In a range 106 which extends in "vertical" direction from $\nu_{yo}$ to the edge of the field of view and in "horizontal" direction from $-\delta$ to $+\delta$, there is no change of the roll position. The sight line 22 lies substantially optimal relative to the window 20. $\Delta\Phi_c=0$. This is the rule "(a)" given above.

Figure 6:
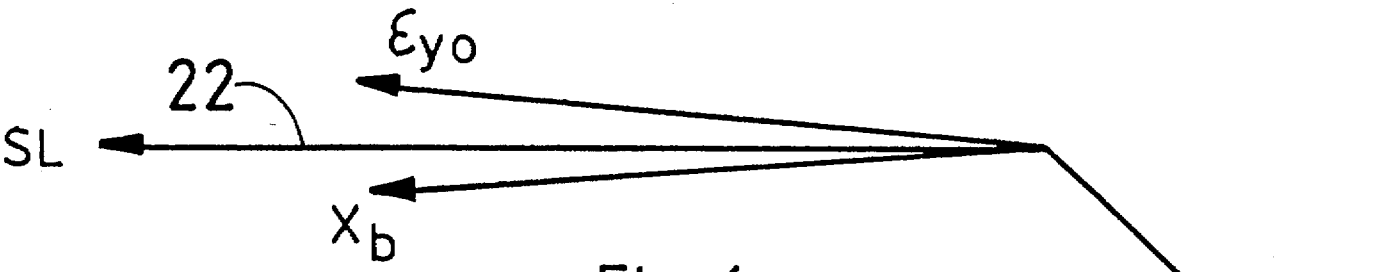
FIGS. 6 and 7 illustrate the effect of a 180°-roll movement of the missile on the relative positions of line of sight and field of view.
Figure 7:
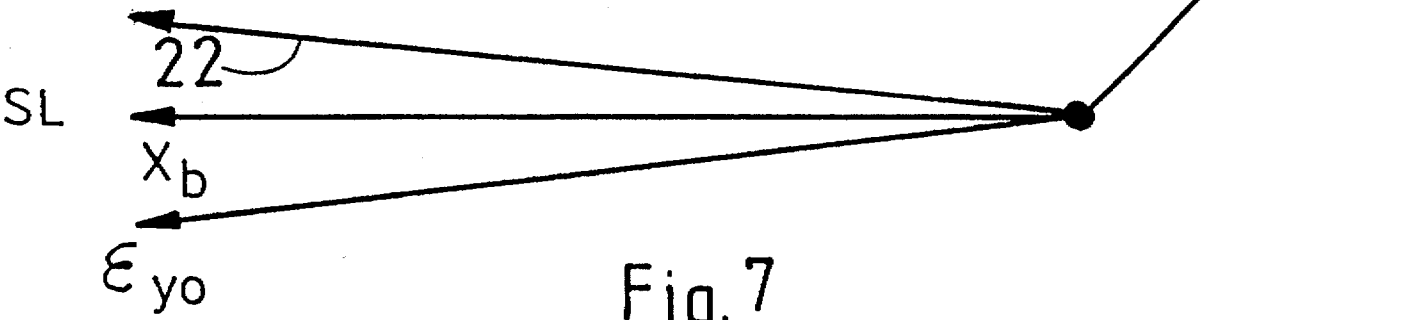

Within a range 108, which extends also from $-\delta$ to $+\delta$ in horizontal direction and which extends, in vertical direction, from $\nu_{yo}$ to the "upper" edge of the field of view, a 180° roll movement of the missile 10 is commanded. The effect of such a 180° roll movement on the relative positions of line of sight and field of view can be understood on the basis of the schematic illustrations of FIGS. 6 and 7. It is assumed, in FIG. 6, that the window 20 faces downwardly. The roll axis $x_b$ of the missile 10 is horizontal. The line of sight 22 is inclined relative to the roll axis $x_b$ in a vertical plane and lies in the range 108 near the edge of the field of view 24. If the missile 10 with the window 20 is then rotated through 180° about the roll axis $x_b$, this will result in a situation as shown in FIG. 7: The orientation of the line of sight 22 and the attitude of the roll axis $x_b$ remain unchanged. The edges $\epsilon_{yo}$ and $-\epsilon_{yu}$ of the field of view 24 are in inverted positions with respect to the roll axis $x_b$. In FIG. 5, this would correspond to a rotation through 180° about the intersection of the $\lambda_{yp}$- and $\lambda_{zp}$-axes. The line of sight lies in the geometrically more favorable angular range of the field of view 22. This corresponds to the rule "(b)" given above.

Figure 8:
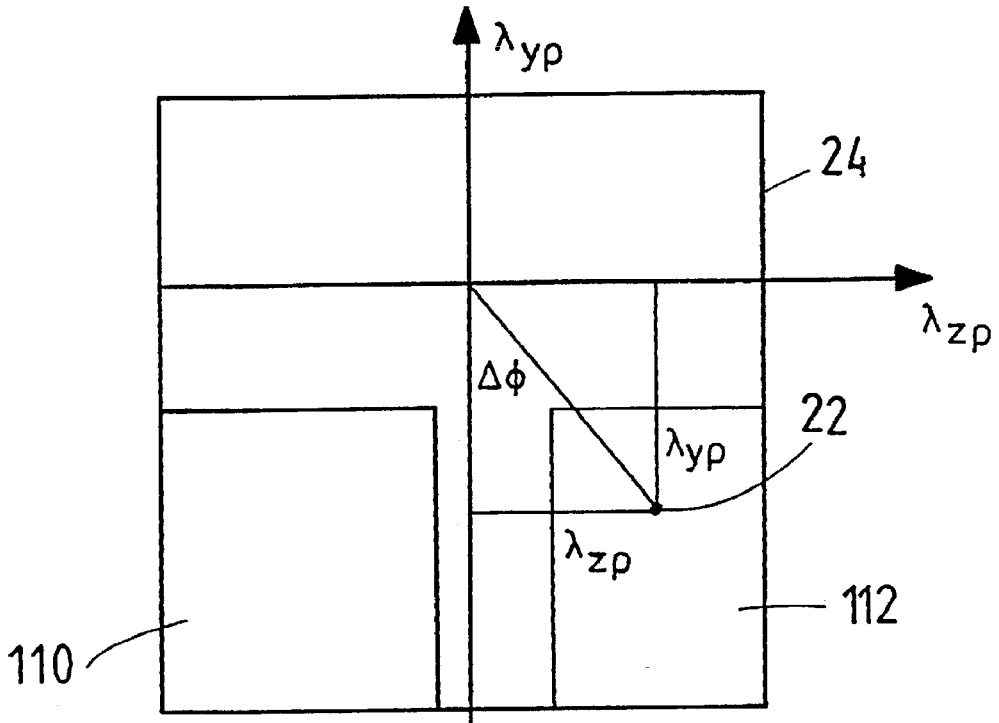
FIG. 8 illustrates the rotary motion of the missile in the case of the line of sight approaching the edge of the field of view.

If the line of sight 22 of the seeker head 16 lies in one of the ranges 110 or 112, thus is laterally offset from the longitudinal center plane of the field of view by more than the angle $\delta$, then the missile 10 is rotated about its roll axis $x_b$ and thus a rotation of the field of view through an angle $\Delta\Phi_c$, that the predicted line of sight 22 again comes to lie on this longitudinal center plane. FIG. 8 yields, for the roll angle $\Delta\Phi_c$, the relation $$\Delta\Phi_c = \tan \lambda_{zp}/\lambda_{yp}.$$

This is rule "(c)" given above.

If the predicted line of sight of the seeker head lies in one of the fields 114 or 116 of FIG. 5 which extend along the "$\lambda_{zp}$-axis", then the missile 10 is rotated through 90° about its roll axis $x_b$. By a rotation through 90°, these "sets of lines of sight" no longer lie on both sides of the $\lambda_{zp}$-axis but on both sides of the $\lambda_{yp}$-axis (rotated by 90°) and, thereby, centrally in the field of view. In the case of the field 114 ($\lambda_{zp}<0$), the missile and thereby the field of view has to be rotated clockwise; in the case of the field 116 ($\lambda_{zp}>0$), the rotation has to be counter-clockwise. Then the predicted line of sight is in the range $0>\lambda_{yp}>-\epsilon_{yu}$ of the field of view.

Figure 9:
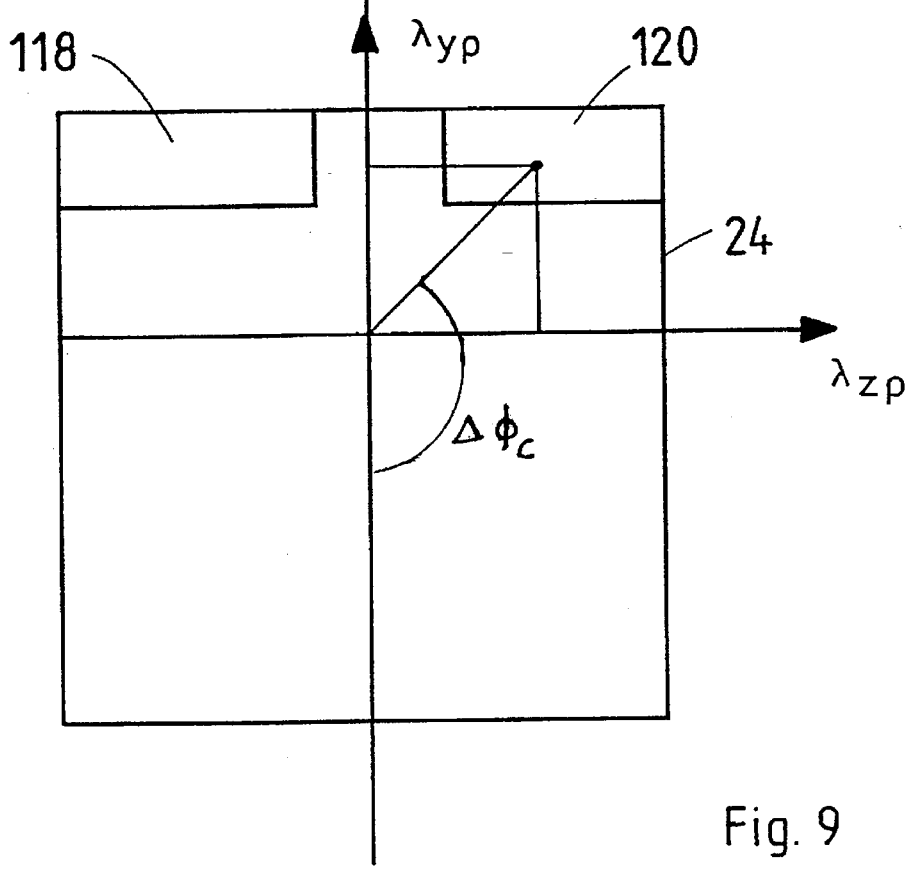
FIG. 9 illustrates the rotary motion of the missile for a further type of relative positions of predicted line of sight and longitudinal axis of the missile.

If the predicted line of sight lies in one of the ranges 118 or 120, then the missile 10 is rotated, as illustrated in FIG. 9, through a roll angle $\Delta\Phi_c$, which results from the relation $\Delta\Phi_c=\arctan(\lambda_{zp}/\lambda_{yp})-180°*\mathrm{sign}(\lambda_{zp})$. By such a rotation of the missile 10 and thus of the field of view 24, a point of the field 118 or 120 representing a line of sight comes to lie on the $\lambda_{yp}$-axis.

With each of the roll positions thus commanded, the limiters 66 and 68 ensure that the line of sight 22 always remains within the limited field of view 104. The commanded roll movements ensure, that the limitation by the limiters need not be too strong. Cooperation of the roll movements commanded by the roll control 100 and the limitation by the limiters 66 and 68 ensures that, on one hand, that there is no target loss and, on the other hand, that the missile is steered with best approximation of the steering law used. Each of the two measures may, however, be used independently of the other one.

We claim:

1. A steering loop for a missile which is guided to a target by means of a seeker head, comprising:

a seeker head having a limited field of view, said seeker head including means for determining a line of sight to a target, said line of sight being defined by look angles about missile-fixed pitch and yaw axes, said seeker head further including means for providing seeker head signals indicative of said look angles, signal processing means, means for applying said seeker head signals to said processing means, said signal processing means processing said seeker head signals to provide signals determining the motion of the missile, and steering means for guiding said missile to said target and means for applying said motion determining signals to said steering means, wherein said signal processing means include signal influencing means for additionally influencing said motion determining signals so as to maintain the missile within a range of attitudes ensuring that the line of sight is kept always within the field of view of said seeker head.

2. A steering loop as claimed in claim 1, wherein said signal processing means comprise:

means for generating, from said seeker head signals, signals for commanding steering-law lateral accelerations of said missile in accordance with a steering law, means for computing predicted look angles resulting from said steering-law lateral accelerations, means for limiting said computed predicted look angles to a range within the field of view of said seeker head, and means for generating lateral acceleration-commanding steering signals depending on said limited, predicted look angles.

3. A steering loop as claimed in claim 2, and further comprising:

means for measuring actual lateral accelerations of said missile;

said predicted look angle computing means comprising:

means for forming the differences of said steering-law lateral accelerations and of associated measured lateral accelerations from said lateral acceleration measuring means, means for predicting look angle changes from said difference in accordance with a predetermined function representing a model of the relation between said lateral acceleration differences and look angle changes due to changes of the angle of attack of said missile required to achieve said steering-law lateral accelerations, and means for forming the sum of said predicted look angle changes and the associated ones of said look angles, derived from said seeker head signals, to provide predicted look angles, which are applied to said limiting means.

4. A steering loop as claimed in claim 3, wherein said means for generating lateral acceleration-commanding steering signals depending on said limited predicted look angles comprise:

means for forming the difference of said limited, predicted look angles and of associated ones of said look angles, means for providing signals representing lateral acceleration changes in accordance with functions which are inverse to the respective functions representing a model of the relation between said lateral acceleration differences and said look angle changes, and means for adding each of said lateral acceleration change-representing signals and the associated one of said measured lateral acceleration signals to provide steering signals.

5. A steering loop as claimed in claim 4, and further comprising means for additionally limiting said steering signals depending on the angle of attack of said missile.

6. A steering loop as claimed in claim 2, and further comprising:

roll control means for controlling roll position of said missile about a roll axis thereof, said predicted look angles being applied to said roll control means, and said roll control means being operative, depending on said predicted look angles to retain said missile in a roll position in which the line of sight is safely within said seeker head field of view.

7. A steering loop as claimed in claim 6, wherein said roll control means have stored therein predetermined rules to be applied to said predicted look angles, said rules yielding said roll position of said missile depending on the ranges of values in which said look angles lie.

8. A steering loop as claimed in claim 7, wherein said rules for determining said roll position of said missile comprise the following rules:

(a) If the predicted yaw look angle $\lambda_{zp}$ and the predicted pitch look angle $\lambda_{yp}$ meet the condition:

$$-\delta \leqq \lambda_{zp} \leqq \delta$$

and $$\lambda_{yp} \leqq V_{yo},$$

$\lambda$ and $V_{yo}$ being the limits of a "window" for the line of sight in the field of view of the seeker head, the roll position of the missile will be retained;

(b) If the predicted look angles lie within ranges $$-\delta \leqq \lambda_{zp} \leqq \delta$$

and $$\lambda_{yp} \geqq V_{yo},$$

a 180° roll rotation of the missile is commanded;

(c) If the predicted look angles $\lambda_{zp}$ and $\lambda_{yp}$ lie in the ranges $$\lambda_{zp} \leqq -\delta;\ \lambda_{yp} \leqq -V_{yo} \text{ or } \lambda_{zp} \geqq \delta;\ \lambda_{yp} \leqq -V_{yo}$$

a roll rotation of the missile through the angle $$\Delta\Phi_c = \arctan(\lambda_{zp}/\lambda_{yp})$$

is commanded; and (d) If the predicted look angles $\lambda_{zp}$ and $\lambda_{yp}$ lie within the ranges $$\lambda_{zp} \leqq -\delta;\ -V_{yo} \geqq \lambda_{yp} \leqq V_{yo} \text{ or } \lambda_{zp} \geqq \delta;\ -V_{yo} \leqq \lambda_{yp} \leqq V_{yo}$$

a roll rotation of the missile through an angle of −90° is commanded in the case of a positive predicted yaw look angle $\lambda_{zp}$, and a roll rotation through an angle of +90° is commanded in the case of a negative predicted yaw look angle $\lambda_{zp}$.

9. A steering loop as claimed in claim 8, wherein said rules for determining said roll position of said missile further include the rule:

If the predicted line of sight lies in one of the ranges $$\lambda_{yp} > v_{yo} \text{ and either } \lambda_{zp} \leqq -\delta \text{ or } \lambda_{zp} \geqq +\delta,$$

then the missile is rotated through a roll angle $\Delta\Phi_c$, which results from the relation $$\Delta\Phi_c = \arctan(\lambda_{zp}/\lambda_{yp}) - 180° * \text{sign}(\lambda_{zp}).$$

10. A steering loop for a missile which is guided to a target by means of a seeker head, comprising:

a seeker head having a limited field of view, said seeker head included means for determining a line of sight to a target, said line of sight being defined by look angles about missile-fixed pitch and yaw axes, said seeker head further including means for providing seeker head signal indicative of said look angles, signal processing means, means for applying said seeker head signals to said processing means, said signals processing means processing said seeker head signals to provide signals determining the motion of the missile, steering means for guiding said missile to said target and means for applying said motion determining signals to said steering means, said signal processing means including means for generating, from said seeker head signals, signals for commanding steering-law lateral accelerations of said missile in accordance with a steering law, means for computing predicted look angles resulting from said steering-law lateral accelerations, and roll control means for controlling roll position of said missile about a roll axis thereof, said computed predicted look angles being applied to said roll control means, said roll control means being operative, depending on said predicted look angles to retain said missile in a roll position in which the line of sight is safely within said seeker head field of view.

11. A steering loop as claimed in claim 10, wherein said roll control means have stored therein predetermined rules to be applied to said predicted look angles, said rules yielding said roll position of said missile depending on the ranges of values in which said look angles lie.

12. A steering loop as claimed in claim 11, wherein said rules for determining said roll position of said missile comprise the following rules:

(a) If the predicted yaw look angle $\lambda_{zp}$ and the predicted pitch look angle $\lambda_{yp}$ meet the condition:

$$-\delta \leqq \lambda_{zp} \leqq \delta$$

and $$\lambda_{yp} \leqq V_{yo},$$

$\lambda$ and $V_{yo}$ being the limits of a "window" for the line of sight in the field of view of the seeker head, the roll position of the missile will be retained;

(b) If the predicted look angles lie within ranges $$-\delta \leqq \lambda_{zp} \leqq \delta$$

and $$\lambda_{yp} \geqq V_{yo},$$

a 180° roll rotation of the missile is commanded; and (c) If the predicted look angles $\lambda_{zp}$ and $\lambda_{yp}$ lie in the ranges $$\lambda_{zp} \leqq -\delta;\ \lambda_{yp} \leqq -V_{yo} \text{ or } \lambda_{zp} \geqq \delta;\ \lambda_{yp} \leqq -V_{yo}$$

a roll rotation of the missile through the angle $$\Delta\Phi_c = \arctan(\lambda_{zp}/\lambda_{yp})$$

is commanded.

13. A steering loop as claimed in claim 12, wherein said rules for determining said roll position of said missile further include the rule:

If the predicted line of sight lies in one of the ranges $$\lambda_{yp} > V_{yo} \text{ and either } \lambda_{zp} \leqq -\delta \text{ or } \lambda_{zp} \geqq +\delta,$$

then the missile is rotated through a roll angle $\Delta\Phi_c$, which results from the relation $$\Delta\Phi_c = \arctan(\lambda_{zp}/\lambda_{yp}) - 180° * \mathrm{sign}(\lambda_{zp}).$$

* * * * *